United States Patent [19]

Sakata et al.

[11] Patent Number: 5,057,966

[45] Date of Patent: Oct. 15, 1991

[54] APPARATUS FOR REMOVING STATIC ELECTRICITY FROM CHARGED ARTICLES EXISTING IN CLEAN SPACE

[75] Inventors: Soichiro Sakata; Takanori Yoshida, both of Kanagawa; Takao Okada, Tokyo, all of Japan

[73] Assignee: Takasago Thermal Engineering Co., Ltd., Tokyo, Japan

[21] Appl. No.: 427,686

[22] Filed: Oct. 13, 1989

[30] Foreign Application Priority Data

Mar. 7, 1989 [JP] Japan ..... 1-52867
Mar. 8, 1989 [JP] Japan ..... 1-55813

[51] Int. Cl.[5] ..... H05F 3/00

[52] U.S. Cl. ..... 361/213; 361/216; 361/220; 361/222

[58] Field of Search ..... 361/212, 213, 216, 220, 361/222, 225, 230, 231, 233, 234

[56] References Cited

U.S. PATENT DOCUMENTS 4,642,728 2/1987 Unger ..... 361/231
4,757,422 7/1988 Bossard et al. ..... 361/231
4,864,459 9/1989 Larigaldie et al. ..... 361/231

OTHER PUBLICATIONS

"Application of Microporous Glass (MPG) for Cleaning Particles in Gas and Liquid"; International Committee of Contamincation Control Societies (ICCCS), 10th International Symposium on Contamination Control (ICCCA 90), Zurich, Switzerland, 10–14 Sep. 1990.

*Primary Examiner*—A. D. Pellinen
*Assistant Examiner*—Jeffrey A. Gaffin
*Attorney, Agent, or Firm*—Wenderoth, Lind & Ponack

[57] ABSTRACT

An apparatus for removing static electricity from charged articles existing in a clean space, particularly in a clean room for the production of semiconductor articles, includes a AC ionizer having a plurality of needle-like emitters disposed in a flow of clean air. A discharge end of each emitter is coated with a dielectric ceramic material. Opposite conductors are also included which are respectively positioned apart from the discharge end of each emitter by a predetermined distance. Each opposite conductor is grounded. Emitters of some of the discharge pairs are connected to a high voltage AC source having added thereto negative voltage bias to thereby form pseudo negative pole emitters, and emitters of the other discharge pairs are connected to a high voltage AC source having added thereto a more positive voltage bias relative to the negative voltage bias to thereby form pseudo positive pole emitters.

16 Claims, 15 Drawing Sheets

43
47
48
VB
VB
TIME
VOLTAGE
0

APPARATUS FOR REMOVING STATIC ELECTRICITY FROM CHARGED ARTICLES EXISTING IN CLEAN SPACE

BACKGROUND OF THE INVENTION

1. Field of the Invention

The present invention relates to the production of semiconductor elements in clean rooms, and more particularly, to an apparatus for dealing with the various difficulties caused by static electrification. Such difficulties include breakdown and performance deterioration of semiconductor devices, surface contamination of products due to absorption of fine particles and operational faults of electronic instruments located in such clean rooms.

2. Description of the Related Art

As high integration, high speed calculation and energy conservation are promoted in semiconductor devices, the oxide insulation films of semiconductor elements have become thinner and the circuits and metal electrodes of such elements have been miniaturized, and thus, static discharge frequently causes pit formations in the elements and/or fusion or evaporation of metallic parts of the elements, leading to breakdown and performance deterioration of the semiconductor devices produced. For example, some MOS-FET and GaAs devices cannot withstand a voltage as low as 100 to 200 volts, and thus, it is frequently necessary to maintain the surface voltage of such semiconductor material elements at about 20 volts or lower. When semiconductor elements have completely broken down, the defect may be detected upon delivery examination. It is, however, very difficult to identify performance deterioration of such elements. In order to reduce static electricity related difficulties, the objective is to reduce to the extent possible the exposure of semiconductors to static electricity, that is, to prevent charged articles from approaching the semiconductor elements, and to neutralize all such charged articles. However, using prior art technology, it has not been possible to completely achieve such an objective. Examples of surface voltage measurements of various articles involved in the production of semiconductor devices include 5 kV for a wafer, 35 kV for a wafer carrier, 8 kV for an acrylic cover, 10 kV for a table surface, 30 kV for a storage cabinet, 10 kV for the technician's garments and 1.5 kV for a quartz palette.

Recent super clean room technology has made it possible to realize a flow of supplied clean air containing no particles having a diameter of 0.03 μm or more. However, fine particles are inevitably generated from the presence of operators, robots and various manufacturing apparatus located in the clean rooms. Such internally generated particles may have a diameter in the range of 0.1 μm to several tens of μm, and when such particles are deposited on the wafers of LSI and VLSE devices having a minimum line distance which is as small as 1 μm, the result is faulty products which reduces the production yield. It has been recently established that the deposition of fine particles on wafers is primarily attributed to electrostatic attraction and that the particular air flow patterns in the vicinity of the wafers is substantially unrelated to such deposition. Accordingly, prevention of such surface contamination of products due to the deposition of fine particles may only be achieved by the development of a technology for removing static electricity which does not directly relate to the technology for enhancing the cleanliness of clean rooms.

Furthermore, in the case wherein electronic equipment is located in the clean room, discharge currents created by the discharge of charged articles, for example charged human bodies and charged sheets of printer paper, may create static noise causing faults in the operation of the electronic equipment. To avoid such operational faults it is desired that the static electricity of charged articles existing in the clean room be eliminated.

To eliminate the above-discussed various difficulties caused by static electrification in the clean room, it is effective to neutralize the charged articles existing in the clean room. In cases where the charged articles are electrically conductive, neutralization can be carried out by simply grounding the charged articles so that static charges can be rapidly removed. However, from a practical standpoint it is impossible to ground all charged articles existing in the clean room, and in cases where the charged articles are insulators, they cannot be neutralized by grounding. As for wafers, although they are themselves conductive, they are transported and handled in cassette cases or palettes which are insulating. Accordingly, it is difficult to neutralize wafers by grounding. For these reasons, there have been proposed systems for removing static electricity which employ ionizers.

The underlying principle of such ionizer systems is as follows. In a clean room, air particles are removed by passing the air through filters in a flow direction, which is substantially one direction. An ionizer for ionizing air by corona discharge (ion generator) is disposed upstream the flow of clean air (normally in the vicinity of the air exhaling surfaces of the filters) to provide a flow of ionized air, which comes in contact with the charged articles to neutralize static electricity on the charged articles. Thus, positively and negatively charged articles are neutralized by negatively and positively ionized air, respectively.

Three general types of corona discharge ionizers are known—the pulsed DC type ionizers, the DC type ionizers and the AC type ionizers. In such ionizers, emitters are disposed in an air space and a high DC or AC voltage is applied to each emitter so that an electric filed of an intensity higher than the dielectric breakdown voltage of air is created in the vicinity of the emitter, thereby effecting corona discharge. The known types of air ionizers will now be described in some detail below.

Pulse DC type. As is diagrammatically shown in FIG. 19, direct currents having, for example, voltages of +13 kV to +20 kV and −13 kV to −20 kV, respectively, are alternately applied at a given time interval (e.g. from 1 to 11 seconds) to a pair of needle-like emitters (tungsten electrodes) 100*a* and 100*b* disposed spaced from each other by a predetermined distance (for example several tens of cm), whereby positive and negative air ions are alternately generated from each of the emitters 100*a* and 100*b*. The ions so generated are carried by air flow to a charged article 101 to neutralize static charges of opposite polarity on the article 101. An example of the DC pulse applied to the emitters is shown in FIG. 20.

DC type. As is diagrammatically shown in FIG. 21, a pair of insulator coated electrically conductive bars 102*a* and 102*b* respectively having a plurality of emitters 103*a* and 103*b* extending therefrom at 1 to 2 cm intervals, are disposed parallel to each other with a predetermined distance (for example several tens of cm) therebetween. A positive DC voltage (e.g. +12 to +30 kV) is applied to the emitters 103*a* of the bar 102*a*, while a negative DC voltage ((e g. from −12 to −30 kV) is applied to the emitters 103*b* of the bar 102*b*, thereby ionizing air.

AC type. An AC high voltage of a commercial frequency of 50/60 Hz is applied to needle-like emitters. As is diagrammatically shown in FIG. 22, a plurality of emitters 104 are arranged in a two dimensional expanse and connected to a high voltage AC source 105 via a frame work of conductive bars 106 having insulating coatings. For each emitter, a grounded grid 107 is disposed as an opposite conductor so that the grid 107 surrounds the discharge end of the emitter 104 with a space therebetween. When the high voltage AC is applied to emitter 104, there is formed an electric field between the emitter 104 and the grounded grid 107. This electric field inverts its polarity in accordance with the cycle of the applied AC, whereby positive and negative ions are generated from the emitter 104.

All such known types of ionizers pose various problems, as noted below, when they are employed to neutralize charged articles in a clean room.

Firstly, the emitters themselves contaminate the clean room. It is said that tungsten is the most preferred material for the emitter. When a high voltage is applied to the tungsten emitter to effect corona discharge, a great deal of fine particles (almost all of them having a diameter of 0.1 μm or less) are sputtered from the discharge end of the emitter upon generation of positive ions, and are carried by the flow of the clean air to thereby contaminate the clean room. Furthermore, since the discharge end of the emitter is damaged by the sputtering, the emitter must frequently be replaced.

Secondly, when an ionizer is made to operate for a prolonged period of time in a clean room, white particulate dust (primarily comprised of $SiO_2$) deposits and accumulates on the discharge end of the emitter to the extent that it may be visible. While the cause of such white particulate dust is believed to be attributed to the material constituting the filters, the deposition and accumulation of the particulate dust on the discharge end of the emitter poses a problem in that ion generation is reduced and contamination is increased due to scattering of the dust. Accordingly, the emitter must frequently be cleaned.

Thirdly, a plurality of emitters disposed on the ceiling of the clean room may increase the concentration of ozone in the clean room. Although the increased ozone concentration is not especially harmful to humans, ozone is reactive and undesirable in the production of semiconductor devices.

In addition to the above-discussed common problems, the individual types of known ionizers involve the following problems.

With DC type ionizers, in which some emitters (emitters 103*a* on the bar 102*a* in the example shown in FIG. 21) generate positive ions, while the other emitters (emitters 103*b* on the bar 102*b* in the example shown in FIG. 21) generate negative ions, and in which such ions are carried by the air flow, frequently there is an imbalance in the number of positive or negative ions which arrive at a charged article. The charged article often receives only ions having the same polarity as that of the static charge thereon. In this case the charged article is not neutralized. On the contrary, an uncharged article or slightly charged article may experience an increased charge as a result of the ions carried thereto. While such a phenomena is likely to occur in the case where the distance between the electrodes (the distance between the rods 102*a* and 102*b* in the example shown in FIG. 21) is fairly large, if the distance is made short to counter this problem, a new problem of sparking is posed.

With pulsed DC type ionizers in which the polarity of the ions is reversed at a predetermined interval, positive and negative ions are alternately supplied to the charged article. Accordingly, the condition in which an imbalance of positive or negative ions is continuously supplied to the charged article, as is the case with the DC type ionizers, is avoided. However, if the pulse period is short there is an increased possibility that the positive and negative ions will admix in the air flow and thus disappear before they reach the charged article. To the contrary, if the pulse period is long, although the possibility that the ions will disappear is decreased, large masses of positive and negative ions will alternately arrive at the charged article. It is reported by Blitshteyn et al. in Assessing The Effectiveness of Cleanroom Ionization Systems, Microcontamination, March 1985, pages 46–52, 76 that with pulsed DC type ionizers, the potential of a charged surface decays in a zigzag manner, for example, as shown in FIG. 23. According to this report, static electricity on a charged surface does not disappear, rather static loads of about +500 volts and about −500 volts alternately appear on the charged surface. Such a large surface potential may reduced the production yield since recent super LSI devices may be damaged even by a surface potential on the order of several tens of volts.

AC type ionizers suffer from an imbalance in the number of generated positive ions and the number of generated negative ions. Frequently, the number of positive ions generated is more than ten times the number of negative ions generated. Shown in FIG. 24 are measurement results reported by M. Suzuki et al. depicting the densities of the positive and negative ions generated by an AC type ionizer. See the Japanese language literature, Proceedings of The 6th. Annual Meeting for Study of Air Cleaning and Contamination Control, (1987) pages 269–276, and the corresponding English language literature, M. Suzuki et al., Effectiveness of Air Ionization Systems in Clean Rooms, 1988 Proceedings of The IES Annual Technical Meeting, Institute of Environmental Sciences, Mt. Prospect, Illinois, pages 405 to 412. As seen from FIG. 24, the density of negative ions is markedly lower than that of positive ions. The measurement as shown in FIG. 24 was made with an AC type ionizer installed in a space wherein clean air was caused to flow downwards in a vertical direction from horizontally disposed HEPA filters. In FIG. 24, a reference symbol "d" designates a vertical distance extending from the point where the measurement was carried out to the emitter points, a reference symbol "l" designates a horizontal distance extending from the point where the measurement was carried out to a vertical line passing through a central point of the ionizer, and the BACKGROUND data denote the positive and negative ion densities of the air flow when the ionizer was OFF. With the conventional AC type ionizers supplying positive ion rich air, the charged surface is not neutralized, rather it may remain positively charged at a potential on the order of several tens of volts to about +200 volts.

SUMMARY OF THE INVENTION

Accordingly, an object of the invention is to provide an apparatus for removing static electricity from charged articles existing in a clean space, particularly in a clean room for the production of semiconductor devices. Particularly, the invention aims to solve the above-discussed problem of the ion imbalance associated with known AC type ionizers, as well as the above-discussed problems common to known ionizers, that is, the contamination of clean rooms due to emitter sputtering, the deposition and accumulation of particulate dust on emitters and the generation of ozone.

The above and other objects are achieved by an apparatus for removing static electricity from charged articles existing in a clean space according to the present invention. Such an apparatus includes an AC ionizer having a plurality of needle-like emitters disposed in the flow of filtered clean air, wherein an AC high voltage is applied to the emitters to effect corona discharge for ionizing air, and whereby a flow of thus ionized air is supplied onto the charged articles to neutralize the static electricity thereof. The apparatus is characterized in that a discharge end of each of the needle-like emitters is coated with a dielectric ceramic material, in that each of the emitters is disposed with its discharge end spaced apart by a predetermined distance from a grounded grid-like or loop-like opposite conductor to form a discharge pair, in that a plurality of such discharge pairs are arranged in a two dimensional expanse in a direction which transverses the flow of clean air, and in that emitters of some of the discharge pairs are connected to a high voltage AC source having added thereto a negative voltage bias to thereby form pseudo negative pole emitters, while emitters of the other discharge pairs are connected to a high voltage AC source having added thereto a voltage bias which is more positive than the negative voltage bias to thereby pseudo positive pole emitters, the pseudo negative pole emitters and pseudo positive pole emitters being discretely arranged in the two dimensional expanse.

We have found that by coating a discharge end of the needle-like emitters with a thin film of dielectric ceramic material, dust generation from the discharge end upon corona discharge in response to the application of an AC high voltage can be minimized without substantially lowering the ionizing ability of the emitter, and that when such an emitter having the discharge end coated with a ceramic material is used in a clean room, not only can the deposition of particulate dust on the discharge end be avoided, but also the ozone generation in the clean room can be minimized. Suitable dielectric ceramic materials which can be used herein include, for example, quartz, alumina, alumina-silica and heat resistant glass. Of these, quartz, in particular transparent quartz, is preferred. The thickness of the ceramic coating on the discharge end of the emitter is suitably 2 mm or less. In the case of transparent quartz, the thickness is preferably 0.05 to 0.5 mm. Incidentally, if a DC high voltage is applied to such an emitter having the discharge end coated with a ceramic material, air can be ionized by an electric field generated at the discharge end of the emitter during the moment of application of DC high voltage. However, after the lapse of a particular time period (for example 0.1 second in an air flow of 0.3 m/sec), ions of a polarity opposite to that of the applied voltage surround the emitter to weaken the electric field at the discharge end of the emitter, whereby generation of ions is no longer continued. Accordingly, it is necessary to use an AC high voltage.

We have further found that the basic problem of the imbalance in the positive and negative ion densities associated with AC type ionizers, as well as the problem of the neutralization of the generated ions existing in the air flow due to the polarity changes with respect to time in accordance with the frequency of the applied AC, can be almost completely solved by adding predetermined bias voltages to the applied AC high voltage so that some emitters (pseudo positive pole emitters) may continuously form positive ion rich air, while the other emitters (pseudo negative pole emitters) may continuously form negative ion rich air in spite of the fact that an AC high voltage is applied. Thus, by suitably locating such pseudo positive pole emitters and pseudo negative pole emitters in a flow of clean air, it is possible to supply air having a balanced number of positive and negative ions to the charged articles which are to be neutralized.

The discharge end of each pseudo negative pole emitter is preferably positioned downstream by a predetermined distance from the corresponding grounded grid-like or loop-like opposite conductor with respect to the flow of air. It is advantageous for emitters of some discharge pairs to be connected to a common high voltage AC source having added thereto a negative bias voltage to thereby form pseudo negative pole emitters, while emitters of the other discharge pairs to be connected to a common high voltage AC source having added thereto a positive bias voltage to thereby form pseudo positive pole emitters. Both of the high voltage AC sources may be conveniently provided using a voltage controlling device equipped to transform commercially available AC into an AC source of a predetermined high voltage and to add respective predetermined positively and negatively biased DC voltages to the transformed AC, and a voltage operating part for adjusting the AC high voltage and the biased DC voltages.

BRIEF DESCRIPTION OF THE DRAWINGS

The invention will now be described in detail with reference to the attached drawings in which.

DETAILED DESCRIPTION OF THE PREFERRED EMBODIMENTS

Figure 1:
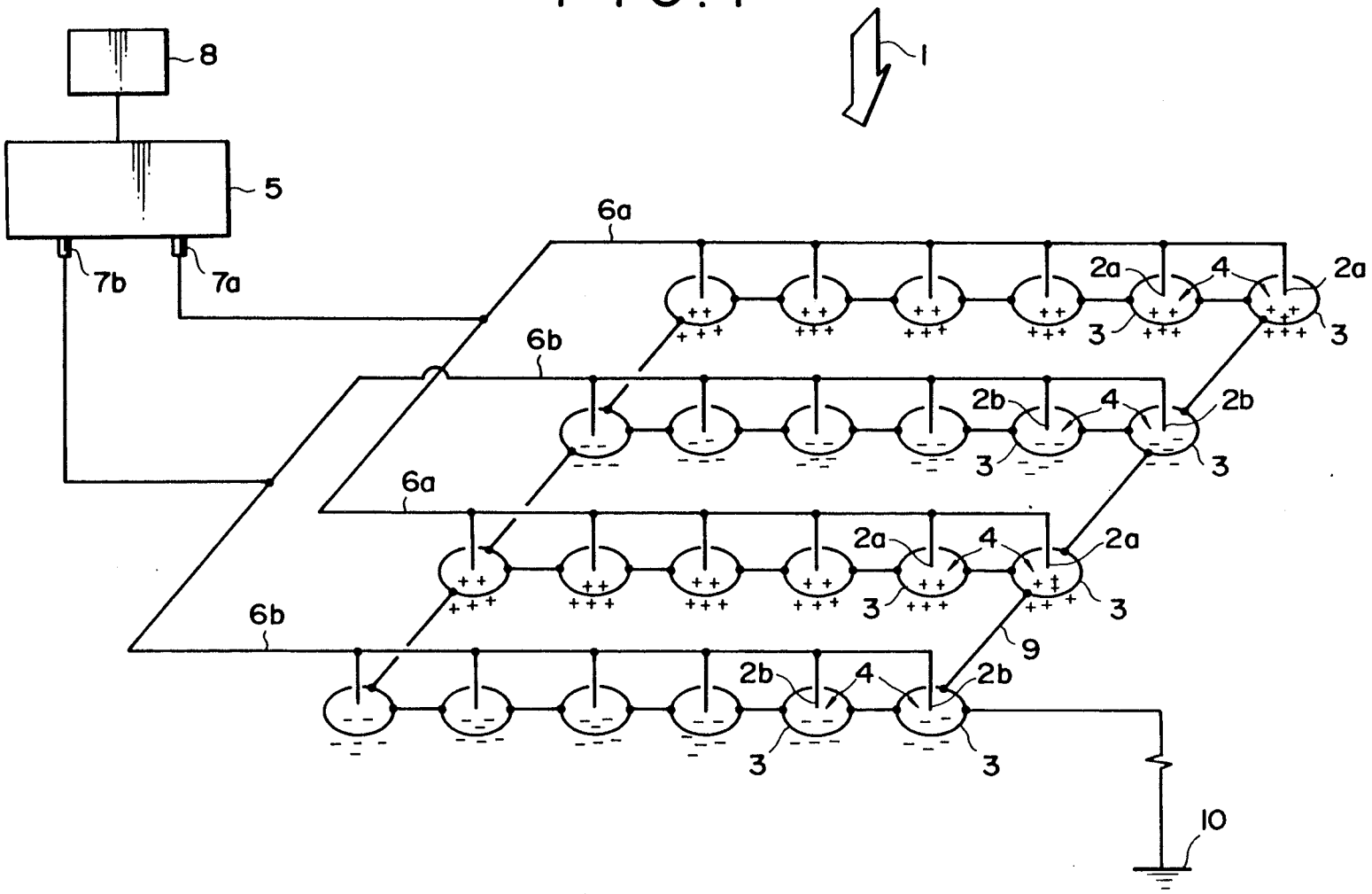
FIG. 1 is a schematic perspective view of an air ionizer used according to the apparatus of the present invention.

FIG. 1 schematically depicts an example of an air ionizer used in the apparatus according to the present invention. The ionizer includes a plurality of discharge pairs 4 which are each made up of a needle-like emitter 2 and a grounded loop-shaped opposite conductor 3. The discharge pairs 4 are arranged in a two dimensional expanse in a direction transversing a flow direction 1 of clean air. HEPA or ULPA filters (not shown) are disposed upstream of the positions of the discharge pairs 4 such that air that is cleaned by the filters passes through the discharge pairs 4. A unidirectional air flow which has passed through the discharge pairs 4 is directed towards the charged articles. In the illustrated example, each needle-like emitter 2 is disposed with its end extending in the downstream direction of the air flow, and each ring-shaped opposite conductor 3 is arranged transversing the air flow. The end of the emitter 2 is positioned on or about an imaginary vertical line passing through the center of the ring of the opposite conductor 3. Further, in the illustrated example, six discharge pairs 4, each including an emitter 2 and opposite conductor 3, are arranged in a line at substantially the same interval, and four such lines are arranged substantially in parallel and substantially within a same plane. Emitters 2*a* in the first line of FIG. 1 and emitters 2*a* in the third line of FIG. 1 are connected through a common insulated conductive line 6*a* to an output terminal 7*a* of a voltage controlling device 5, while emitters 2*b* in the second line of FIG. 1 and emitters 2*b* in the fourth line of FIG. 1 are connected through a common insulated conductive line 6*b* to an output terminal 7*b* of the voltage controlling device 5. As described later in more detail, the output terminal 7*b* supplies a high AC voltage having added thereto a predetermined negatively biased voltage, whereas the output terminal 7*a* supplies a high AC voltage having added thereto a predetermined less negatively biased voltage relative to the output terminal 7*b*, or optionally a positively biased voltage. A reference numeral 8 designates a voltage operating part of the voltage controlling device 5. All of the ring-like opposite conductors 3 are grounded by a common insulated conductive line 9 to the earth-ground 10.

Figure 2:
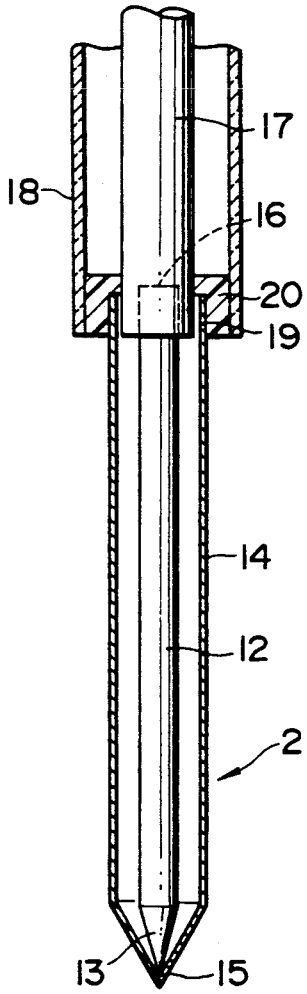
FIG. 2 is a cross-sectional view of an example of an emitter which may be used in the ionizer of FIG. 1.

FIG. 2 is a cross-sectional view of an example of the emitter 2. The emitter used herein is characterized in that its discharge end is coated with a dielectric ceramic material. The emitter illustrated in FIG. 2 comprises a tungsten rod 12 having a tapered needle portion 13 at one end and a tube 14 of a ceramic material concentrically containing the tungsten rod 12. The ceramic tube 14 also has a sealed tapered end portion 15. The tungsten rod 12 is placed so that the end of its tapered needle portion 13 comes in contact with inner surface of the tapered end portion 15 of the ceramic tube 14, whereby the tapered needle portion 13 of the tungsten rod 12 is coated with the thin ceramic tube 14. In the example shown in FIG. 2, the outer diameter of the tungsten rod 12 is slightly smaller than the inner diameter of the ceramic tube 14, and the tapered needle portion 13 of the tungsten rod 12 tapers at an angle which is more acute than that of the tapered end portion 15 of the ceramic tube 14. Thus, by encapsulating the tungsten rod 12 with the ceramic tube 14 so that the tapered needle portion 13 of the former contacts the tapered end portion 15 of the latter, the center of the end of the tapered needle portion 13 of the tungsten rod 12 may be naturally fitted to the center of the inside surface of the tapered end portion 15 of the ceramic tube 14. The other end 16 of the tungsten rod is jointed to a metallic conductor 17. This joint is made by intimately and concentrically inserting a predetermined depth of the tungsten rod 12 at its end 16 into an end of a metallic rod 17 having a diameter larger than that of the tungsten rod 12. The metallic rod 17 is received in a tube 18 of an insulating material such as glass, to which the other end 19 of the ceramic tube 14 is also connected via a seal member 20. As shown in FIG. 2, the emitter 2 is positioned with its discharge end 21 having a ceramic cover spaced apart from the corresponding grounded ring-shaped opposite conductor 3 by a predetermined distance and substantially along an imaginary vertical central line of the opposite conductor ring 3. This positioning is made by suspendedly supporting the emitters 2 on an insulated conductor 6 which is sufficiently rigid to support the emitters 2 and thus in itself serves as a frame member for supporting the emitters. The insulated conductor 6 may include a relatively thick metallic conductor 17 coated with an insulating resin 22 (for example, fluorine resins such as "Teflon"), and also serves as a frame member for supporting opposite conductors 3 via insulating supporting members. By connecting the emitters 2 to the insulated conductor 6 via respective joint members 23 at intended positions, the emitters 2 can be arranged in the air flow without significantly disturbing the air flow.

Figure 4:
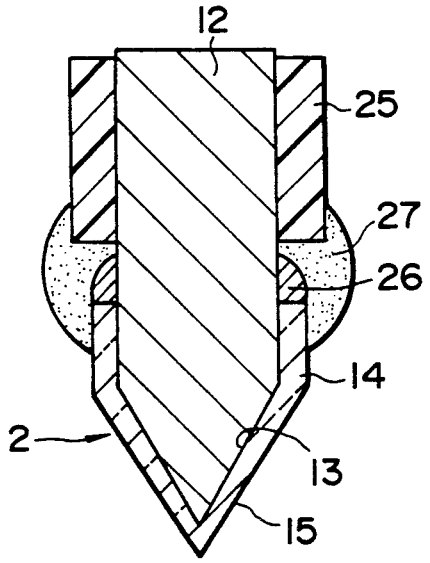
FIG. 4 is a cross-sectional view of another example of an emitter which may be used in the ionizer of FIG. 1.
Figure 5:
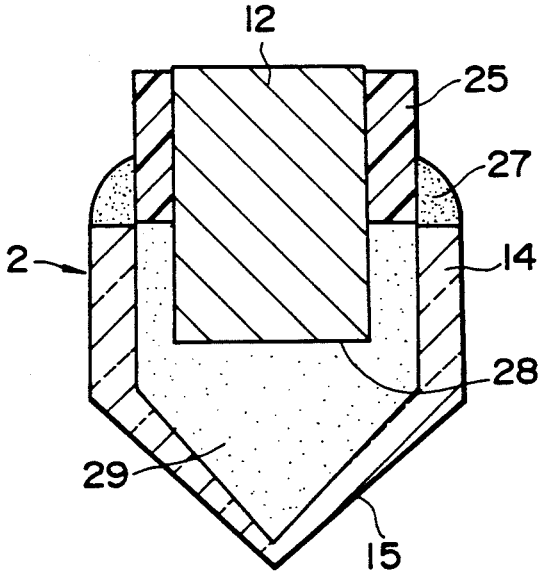
FIG. 5 is a cross-sectional view of a further example of an emitter which may be used in the ionizer of FIG. 1.

The emitter 2 used herein should have its discharge end coated with a dielectric ceramic material. Examples of such a dielectric ceramic material include, for example, quartz, alumina, alumina-silica and heat resistant glass. Of these, quartz, in particular transparent quartz, is preferred. The thickness of the ceramic coating of the needle portion 13 of the tungsten rod 12 is suitably 2 mm or less, preferably 0.05 to 0.5 mm. The ceramic coating should also have a tapered end portion (an acute end 15 as shown in FIG. 2). Portions of the tungsten rod 12 other than the needle portion which do not normally act as a discharge location, such as a body portion of the tungsten rod 12, are not necessarily coated with a ceramic material. Such examples are shown in FIGS. 4 and 5. FIG. 4 depicts a tungsten rod 12 with its tapered end coated with a ceramic tube 14, and the body portion of the tungsten rod 12 is coated with another insulating material (e.g. an insulating resin) 35. The ceramic tube 14 is bonded to the tungsten rod 12 by means of an adhesive 26 (e.g. an epoxy resin based adhesive), and the bond portion is covered with a sealing agent 27 (e.g. a silicone sealing agent) so that the tungsten may not be exposed. In this example, there is no spacing between the outer surface of the tapered needle portion 13 of the tungsten rod 12 and the inner surface of the tapered end portion 15 of the ceramic tube 14. FIG. 5 depicts an example in which a conductive adhesive 29 is located between an end 28 of the tungsten rod 12 and the tapered end portion 15 of the ceramic tube 14. Namely, the end 28 of the tungsten rod 12 extending beyond the insulating coating 25 is covered by the ceramic tube 14 having the tapered end portion 15 to define a void therebetween, and the void is filled with the conductive adhesive 29. A reference numeral 27 designates a sealing agent, as in the case with FIG. 4. Examples of the conductive adhesive 29 which can be used herein include, for example, a dispersion of particulate silver in an epoxy adhesive and a colloidal dispersion of graphite in an adhesive. In the example shown in FIG. 5, the end 28 of the tungsten rod 12 may or may not be pointed.

Figure 6:
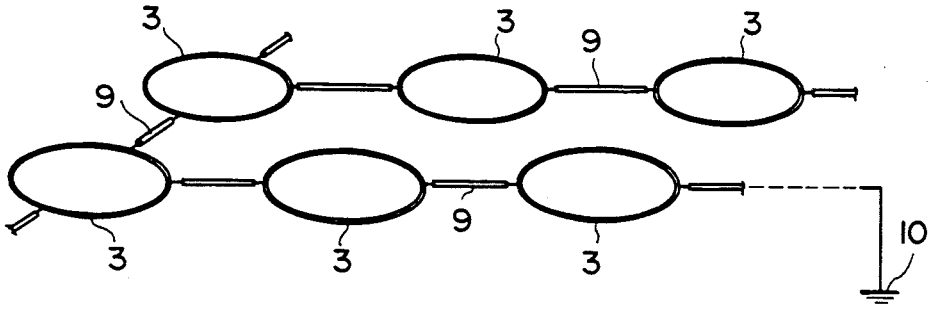
FIG. 6 is a perspective view showing grounded loop-shaped opposite conductors which may be used in the ionizer in FIG. 1.

FIG. 6 is an enlarged perspective view showing several of the grounded loop-shaped opposite conductors 3 of FIG. 1. In this example, each opposite conductor 3 comprises a metal ring, and a required number of such rings are connected together at a predetermined interval by a conductor 9 having an insulating coating so that they may be installed substantially within a same plane of a two dimensional expanse. The conductor 9 is sufficiently rigid to hold the position of the ring-shaped opposite conductors 3, and thus serves as a frame support for the opposite conductors 3. The opposite conductors 3 are grounded to the earth-ground 10 by means of the conductor 9. Since the conductor 9 serves as a frame for supporting the opposite conductors 3, a separate member for supporting the opposite conductors 3 is not required, and thus, a flow of clean air passing through the assembly of the opposite conductors 3 will not be significantly disturbed. The opposite conductors 3 are preferably shaped as a perfect circle as illustrated herein. However, they may be in the shape of an ellipse or a polygon. Alternatively, the opposite conductor 3 may be formed as grids as in the conventional AC type ionizers by perpendicularly intersecting a plurality of straight lines within a plane. In any event, the opposite conductor 3 is not coated with a ceramic material, and is used with the metal surface thereof exposed.

Figure 7:
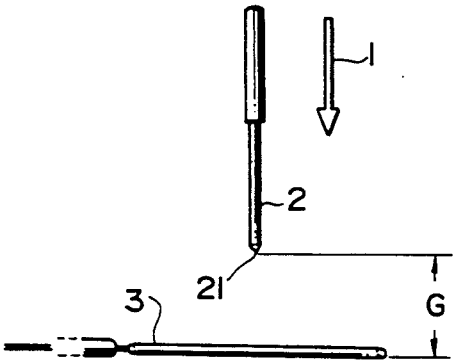
FIG. 7 is a side view showing an example of the relative position of the emitter and the corresponding opposite conductor which may be used in the ionizer of FIG. 1.
Figure 8:
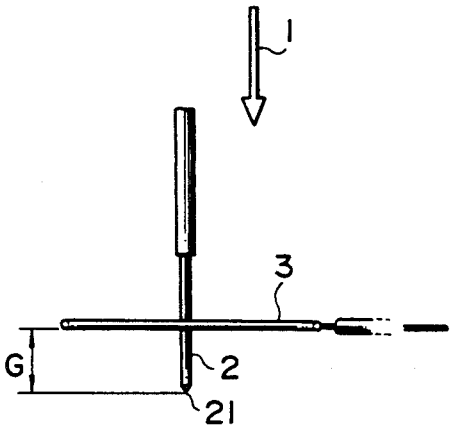
FIG. 8 is a side view showing another example of the relative position of the emitter and the corresponding opposite conductor which may be used in the ionizer in FIG. 1.

FIGS. 7 and 8 show examples of the relative position of the emitter 2 and the corresponding opposite conductor 3, which constitute a discharge pair 4 (FIG. 1). In both the examples, the emitter 2 and the opposite conductor 3 are installed along the air flow direction 1 and transversing the air flow direction 1, respectively, so that the emitter is positioned on or about an imaginary vertical line passing through the center of the opposite conductor 3. In the example of FIG. 7, the emitter 2 is installed with its discharge end 21 positioned upstream of the opposite conductor 3 with respect to the air flow by a distance G. Whereas in the example of FIG. 8, the emitter 2 is installed with its discharge end 21 positioned downstream of the opposite conductor 3 with respect to the air flow by a distance G. Namely, the emitter 2 extends through the ring of the opposite conductor 3 in the example of FIG. 8, whereas it does not do so in the example of FIG. 7. Which embodiment should be adapted is determined depending upon the conditions of the applied voltage, as described hereinafter.

As already described, the first characteristic feature of the present invention resides in the use of emitters having discharge ends coated with a dielectric ceramic material in an AC type ionizer. The second characteristic feature of the present invention resides in the manner of applying an AC high voltage to such emitters. We have found that upon application of an AC high voltage to emitters having discharge ends coated with a dielectric ceramic material, by adding appropriate bias voltages to the AC high voltage, it is possible to cause some emitters to continuously form positive ion rich air, while causing the other emitters to continuously form negative ion rich air, in spite of the fact that an AC high voltage is applied. Conventional AC type ionizers alternately generate positive and negative ions in accordance with the frequency of the AC utilized, but result in a substantial imbalance in the densities of the generated positive and negative ions. On the other hand, as already described, when a DC high voltage is applied to an emitter having its discharge end coated with a ceramic material, although air can be ionized during a moment of application of the DC high voltage, ions of a polarity opposite to that of the applied AC voltage immediately surround the emitter to weaken the electric field at the discharge end of the emitter, and thus, generation of ions is no longer continued. In accordance with one aspect of the present invention there is provided an improved AC type ionizer capable of continuously generating positive ions from some emitters while continuously generating negative ions from the other emitters. The ionizer described herein generates substantially only positive ions from some of its emitters while generating substantially only negative ions from its remaining emitters in spite of the fact that an AC high voltage is applied to the emitters, instead of alternately generating positive and negative ions in accordance with the frequency of the applied AC. Most typically, an AC high voltage having added thereto a negative voltage bias is applied to some emitters, which an AC high voltage having added thereto a more positive voltage bias is applied to the other emitters. Referring back to FIG. 1, an AC high voltage having added thereto a negative voltage bias is applied to the group of emitters denoted **2*b*, thereby causing the emitters 2*b*** to continuously form negative ion rich air, and an AC high voltage having added thereto a more positive voltage bias is applied to the group of emitters denoted 2*a*, thereby causing the emitters 2*a* to continuously form positive rich air.

Strictly speaking, every emitter may become either a positive or negative pole, since an AC voltage is applied thereto. For explanation purposes, an emitter to which an AC high voltage having added thereto a negative voltage bias is applied and which is capable of continuously forming negative ion rich air is referred to herein as "a pseudo negative pole emitter", and an emitter to which an AC high voltage having added thereto a more positive voltage bias is applied and which is capable of continuously forming a positive ion rich air is referred to herein as "a pseudo positive pole emitter". In FIG. 1, the emitters 2*a* are pseudo positive pole emitters, while the emitters 2*b* are pseudo negative pole emitters. All of the pseudo positive pole emitters 2*a* are connected to the output terminal 7*a* of the voltage controlling device 5 via the insulated conductive wire 6*a*, while all the pseudo negative pole emitters 2*b* are connected to the output terminal 7*b* of the voltage controlling device 5 via the insulated conductive wire 6*b*. The terminal 7*a* and the terminal 7*b* output respectively AC high voltages having added thereto the bias voltages which are different from each other in intensity and possibly polarity. A reference numeral 8 in FIG. 1 designates a voltage operating part for operating or controlling the nature of the AC voltages from the terminals 7*a* and 7*b*.

Figure 9:
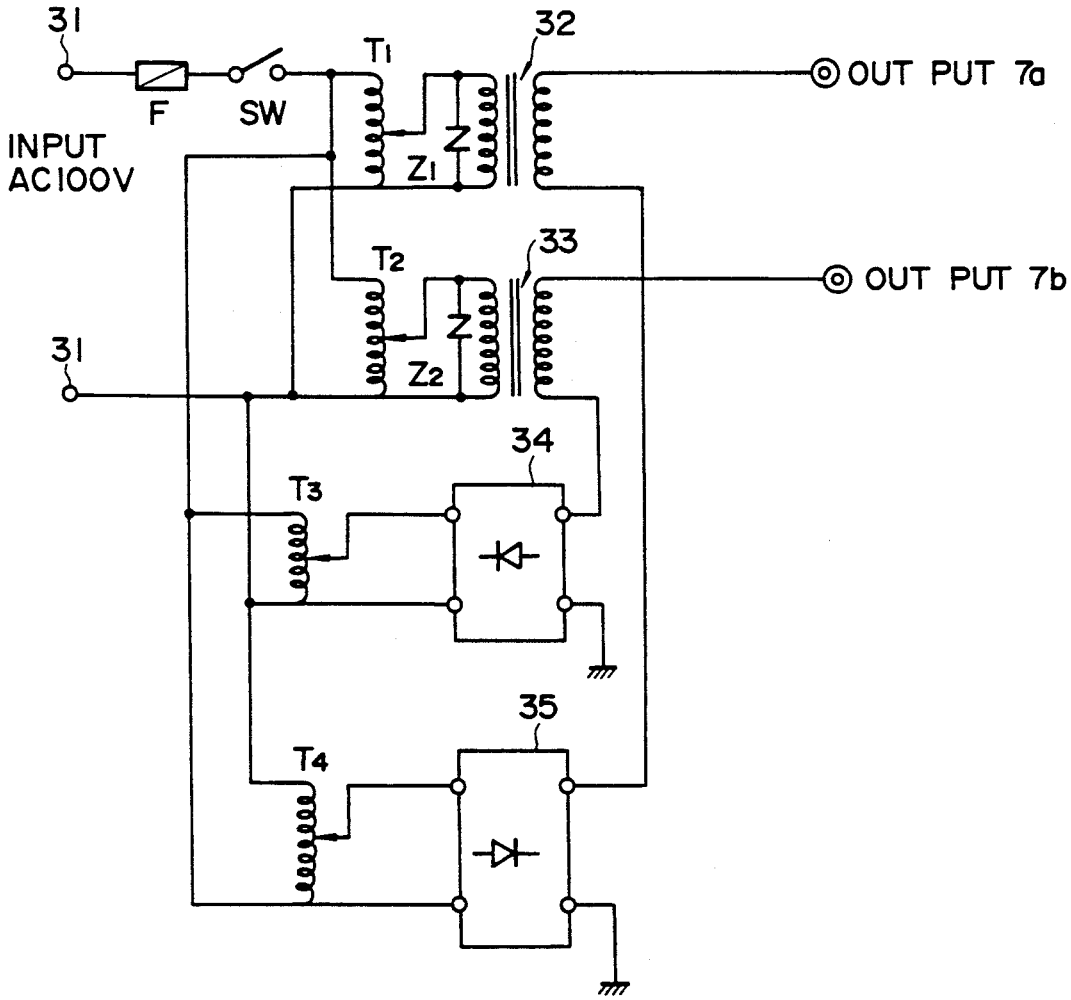
FIG. 9 is a diagram showing an example of a circuit for a voltage controlling device and its voltage operating part which may be used in the ionizer of FIG. 1.

FIG. 9 is a diagram showing a circuit for a voltage controlling device 5 and its voltage operating part 8 which may be used in the ionizer of FIG. 1. The illustrated circuit comprises a common input terminal 31 having applied thereto a commercial AC (100 V in the illustrated example) and transformers 32, 33, 34 and 35 arranged in parallel. Variable resistances (slide rheostats) $T_1$, $T_2$, $T_3$ and $T_4$ are provided at the input side of the transformers 32, 33, 34 and 35, respectively. These slide rheostats constitute the voltage operating part 8 of FIG. 1. The transformer 32 transforms the commercial AC (100 V) to a given voltage (e.g. 8 kV or higher) and outputs the transformed AC on the terminal 7*a* connected to the pseudo positive pole emitters 2*a* (FIG. 1). The transformer 33 transforms the commercial AC (100 V) to a given voltage (e.g. 8 kV or higher) and outputs the transformed AC on the terminal 7*b* communicating wit the pseudo negative pole emitters 2*b* (FIG. 1). Accordingly, the transformers 32 and 33 are ordinary AC transformers which transform the commercial AC to a higher voltage without altering the frequency. The transformers 34 and 35 include a respective rectifier and serve to rectify the commercial AC to a DC voltage and thereafter transform the DC voltage to a higher voltage. Accordingly, the transformers 34 and 35 will be referred to herein as DC transformers. The DC transformer 34 outputs a DC of an elevated negative voltage, and is connected to one side of a secondary coil of the transformer 33. Thus, from the terminal 7*b* there is output a combined voltage of the AC component of a voltage from the transformer 33 and the DC negative voltage bias from the transformer 34. On the other hand, the DC transformer 35 outputs a DC of an elevated more positive voltage, and is connected to one side of a secondary coil of the transformer 32. Thus, from the terminal 7*a* there is output a combined voltage of the AC component of a voltage from the transformer 32 and the more positive DC voltage bias from the transformer 35. In FIG. 9, a reference symbol F designates a fuse, SW a switch for the electric source, and $Z_1$ and $Z_2$ spark absorbers for inhibiting noise at the time of switching-on to thereby reduce the supply of a pulse component. According to the circuit of this construction, the intensities of the AC voltage and DC positive voltage bias which are output from the terminal 7*a* to the pseudo positive pole emitters 2*a* (FIG. 1) can be controlled at will by operating the slide rheostats $T_1$ and $T_4$. Likewise, the intensities of the AC voltage and DC negative voltage bias which are output from the terminal 7*b* to the pseudo negative pole emitters 2*b* (FIG. 1) can be controlled at will by operating the side rheostats $T_2$ and $T_3$.

Figure 10:
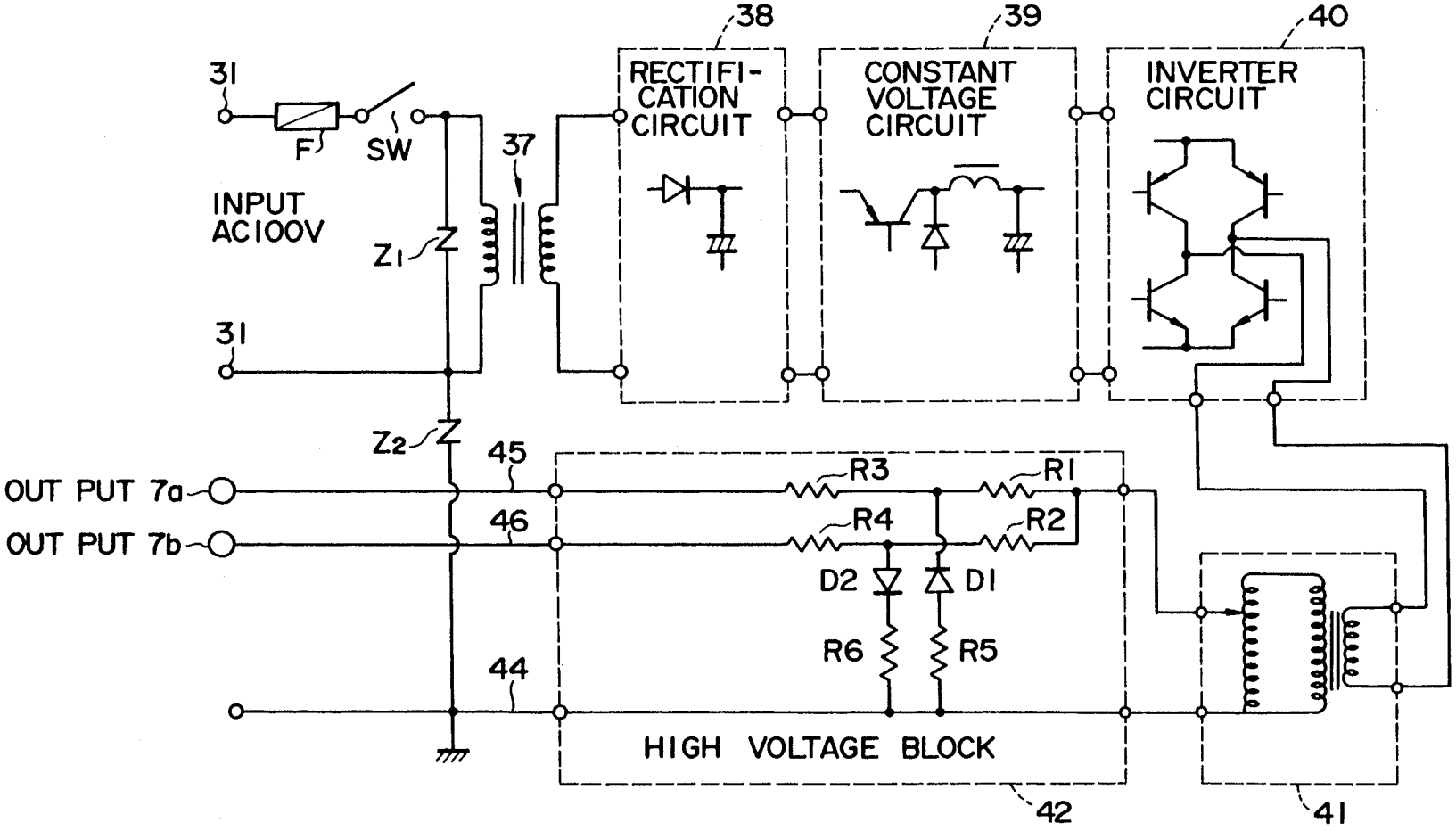
FIG. 10 is a diagram showing an example of a preferred assembly of circuits for a voltage controlling device and its voltage operating part which may be used in the ionizer of FIG. 1.
Figure 11:
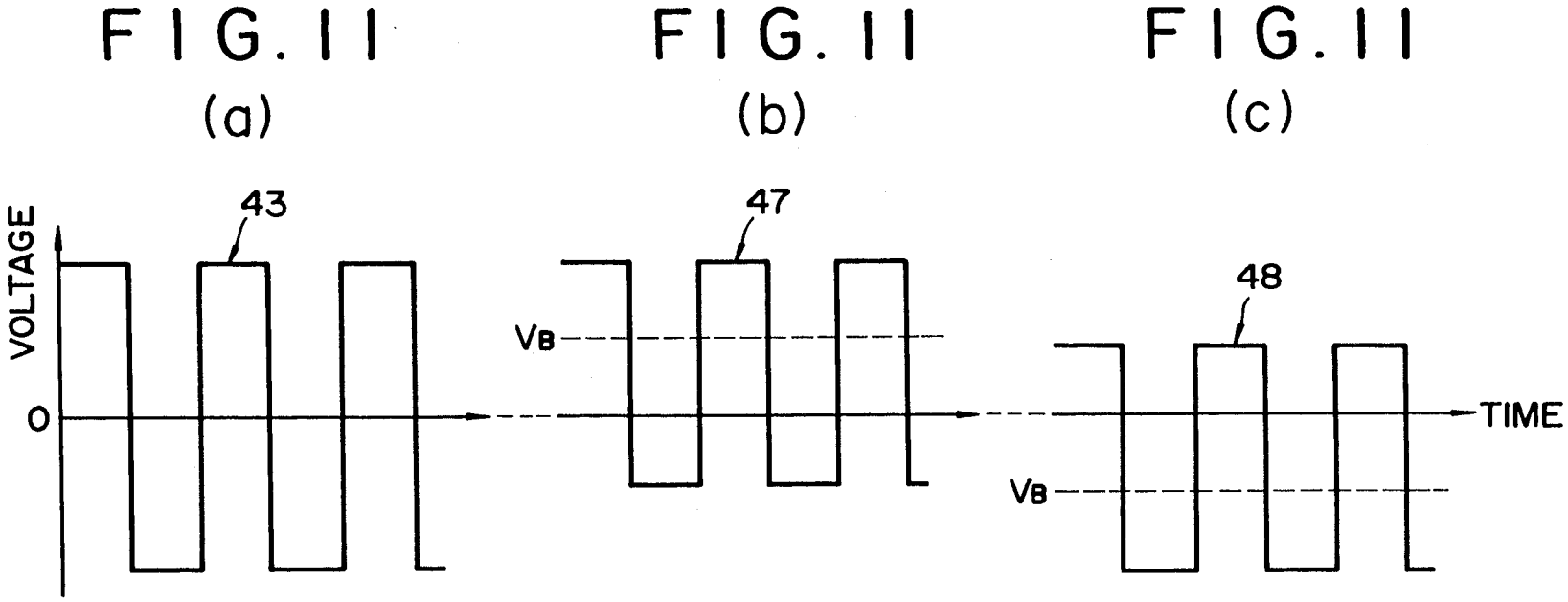
FIG. 11(*a*)-(*c*) show examples of square waves obtained by the circuit assembly in FIG. 10.

FIG. 10 is a diagram showing a preferred circuit assembly for a voltage controlling device 5 and its voltage operating part 8 which may be used in the ionizer of FIG. 1. The illustrated circuit assembly includes an input terminal 31 for applying thereto commercial AC (100 V), a transformer 37 connected to the input terminal 31, and a rectification circuit 38, a constant voltage circuit 39, an inverter circuit 40, a high voltage transformer 41 and a high voltage block 42 connected in series to the secondary side of the transformer 37. The AC from the transformer 37 undergoes full wave rectification in the rectification circuit 38, thus becoming DC. The constant voltage circuit 39 provides a constant voltage output. When the voltage of the commercial AC employed varies for some reason, the DC voltage from the rectification circuit 38 varies accordingly, and in turn the input voltage to the subsequent high voltage transformer 41 varies, and the eventual output voltage cannot be kept constant. Accordingly, the constant voltage circuit 39 is utilized. The inverter circuit 40 is incorporated with an oscillation circuit, and chops the constant DC voltage output from the constant voltage circuit 39 into a square wave, which is then transformed by the high voltage transformer 41 into square wave AC as shown in FIG. 11(*a*) as reference numeral 43. The high voltage transformed 41 includes an insulated transformer incorporated with a slide rheostat to vary the output AC voltage. The AC voltage from the high voltage transformer 41 is passed through the high voltage block 42, in which high voltage rectifiers (diodes D1 and D2 and high voltage resistances R1 to R6) are incorporated, and is output to the terminals 7*a* and 7*b*. In the high voltage block 42, a secondary coil of the transformer 41 is branched so that it is connected to a grounded line 44 at one side and to output lines 45 and 46 which respectively lead to the terminals 7*a* and 7*b*. Between the output line 45 leading to the terminal 7*a* and the grounded line 44 there is inserted a diode D1 which allows only a negative current to flow therethrough. Between the output line 46 leading to the terminal 7*b* and the grounded line 44 there is inserted a diode D2 which allows only a positive current to flow therethrough. Further, resistances R1 to R6 are incorporated in the high voltage block 42 in the manner as shown in FIG. 10 Thus, to the terminal 7*a* , a positive voltage from the transformer 41 is applied as it is, but a negative voltage applied to the terminal 7*a* approaches 0 according to an amount negative current flow to ground via the diode D1. The amount of the negative current which is allowed to flow to ground can be adjusted by the resistances R1 to R5. As a result, a positively biased AC voltage (e.g. having a waveform 47 as shown in FIG. 11 (*b*)) is applied to the terminal 7*a*. In this case, it can be said that a positive voltage bias $V_B$ has been added to the AC. Likewise, a negatively biased AC voltage (e.g. having a waveform 48 as shown in FIG. 11 (*c*)) is applied to the terminal *7b*. In this case, it can be said that a negative voltage bias $V_B$ has been added to the AC. In the case of the circuit assembly shown in FIG. 10, the intensity of the AC voltage which is output to the pseudo positive pole emitters *2a* (FIG. 1) and to the pseudo negative pole emitters *2b* (FIG. 1) can be controlled at will using the slide rheostat part of the high voltage transformer 41. Further, the intensity of the positive voltage bias $V_B$ which is applied to the terminal *7a* and to the pseudo positive pole emitters *2a* (FIG. 1) can be controlled at will by adjusting a ratio of the resistances R1 and R5, more precisely by adjusting the ratio R5/(R1+R5). Likewise, the intensity of the negative voltage bias $V_B$ which is applied to the terminal and to the pseudo negative pole emitters *2b* (FIG. 1) can be controlled at will by adjusting a ratio of the resistances R2 and R6, more precisely by adjusting the ratio R6/(R2+R6).

The circuit assembly of the voltage controlling device 5 (FIG. 1) and its voltage operating part 8 (FIG. 1) as shown in FIGS. 9 and 10 are preferred. However, the basic requirements of the circuit assembly are that the terminal *7b* can provide a high voltage AC which is obtained by the transformation of commercial AC to a high voltage (e.g. 8 kV or more) followed by the addition thereto of a negative voltage bias, that the increase in the voltage by the transformation and the bias amount are adjustable, that the terminal can provide a high voltage AC which is obtained by transformation of commercial AC to a high voltage (e.g. 8 kV ore more) followed by the addition thereto of a more positive voltage bias relative to the negative voltage bias, or optionally a positive voltage bias, and that the increase in the voltage by the transformation and the bias amount are adjustable. So far as these requirements are met, any circuit or circuits can be used herein.

During the operation of the apparatus according to the present invention, the pseudo negative pole emitters *2b* (FIG. 1), in spite of the fact that an AC high voltage is being applied thereto, continuously form ionized air having a high negative ion density and a low positive ion density of approximately zero, and the so formed negative ion rich air is carried by the flow of clean air to charged articles. On the other hand, the pseudo positive pole emitters *2a* (FIG. 1), in spite of the fact that an AC high voltage is being applied thereto, continuously form ionized air having a high positive ion density and a low negative ion density, and the so formed positive ion rich air is carried by the flow of clean air to charged articles. Accordingly, by appropriately arranging a plurality of the pseudo negative pole emitters *2b* and pseudo positive pole emitters *2a* in a two dimensional expanse which transverses the air flow, for example, by alternately arranging a line of the emitters *2b* and a line of the emitters *2a* as shown in FIG. 1, or by arranging the individual emitters *2b* and *2a* alternately in a zigzag manner, or by arranging a small group of the emitters *2b* and a small group of the emitters *2a* alternately, it is possible to supply well balanced positive and negative ion densities to charged articles which exist downstream of the ionizer.

Figure 3:
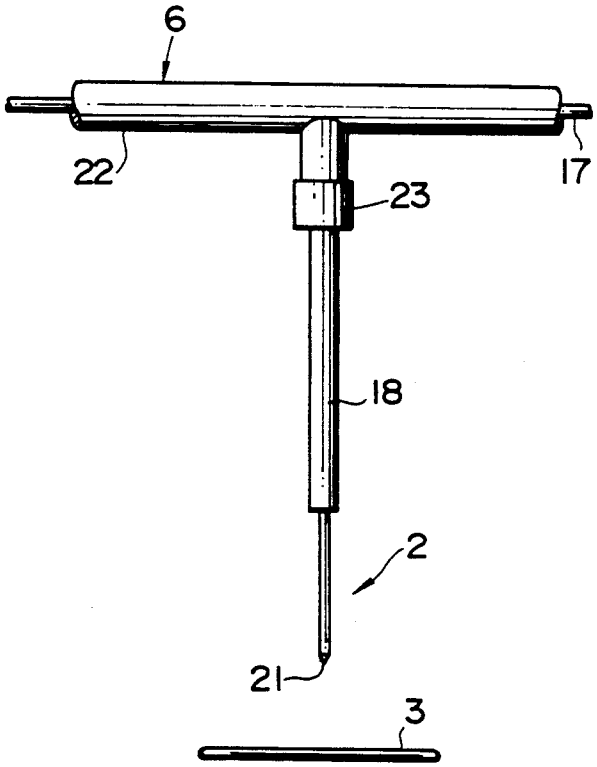
FIG. 3 is an enlarged side view showing an emitter and opposite conductor pair which may be used in the ionizer of FIG. 1.
Figure 12:
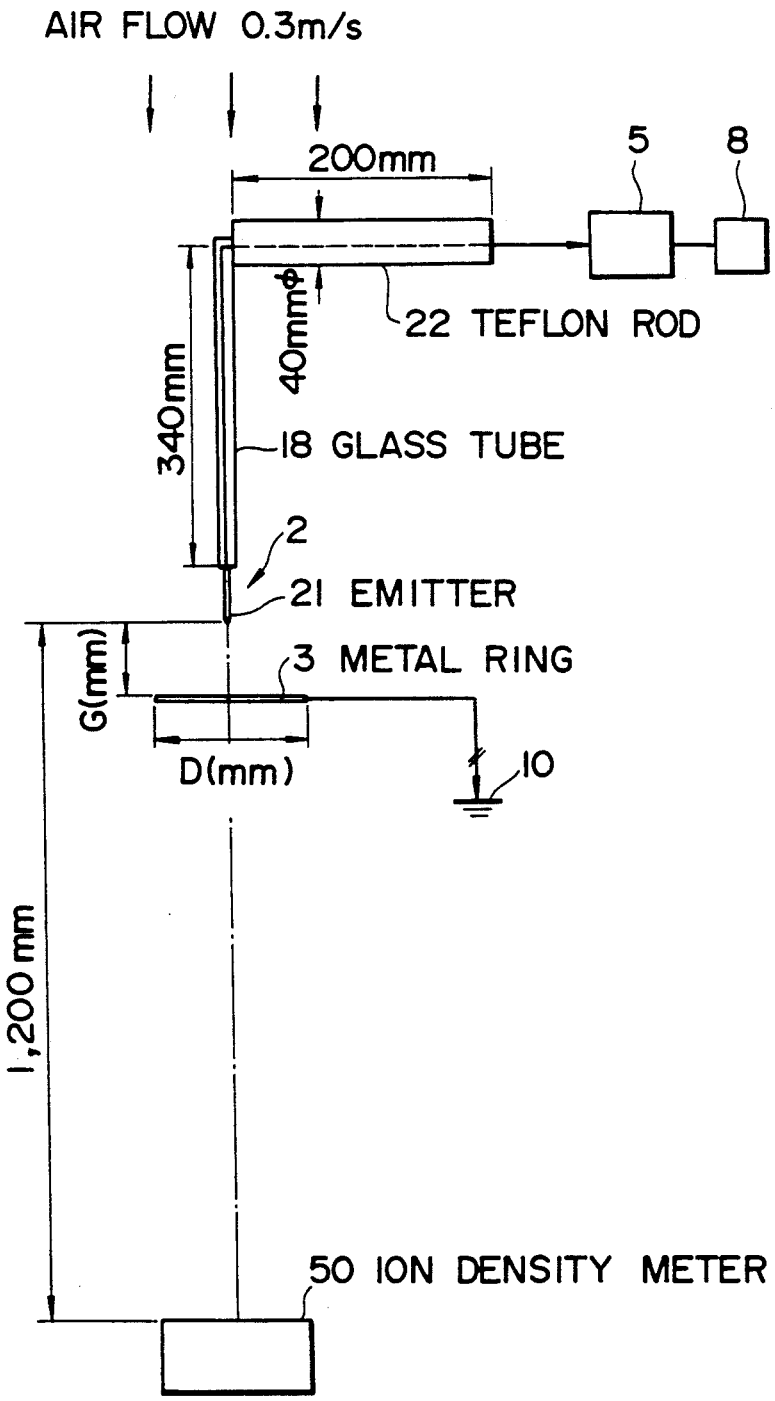
FIG. 12 illustrates a testing method and apparatus used herein.
Figure 13:
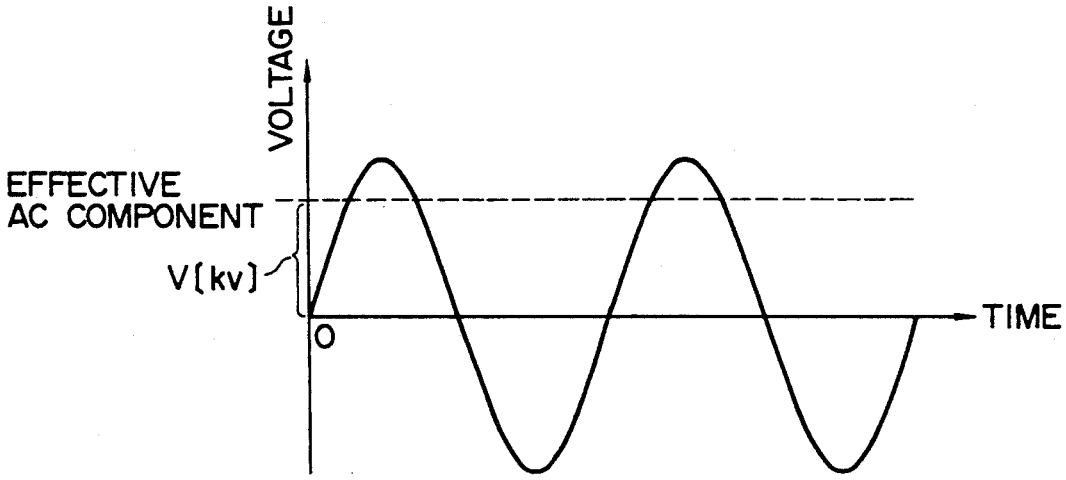
FIG. 13 is a wave diagram for illustrating an effective AC component of a high voltage AC applied in the test of FIG. 12.
Figure 14:
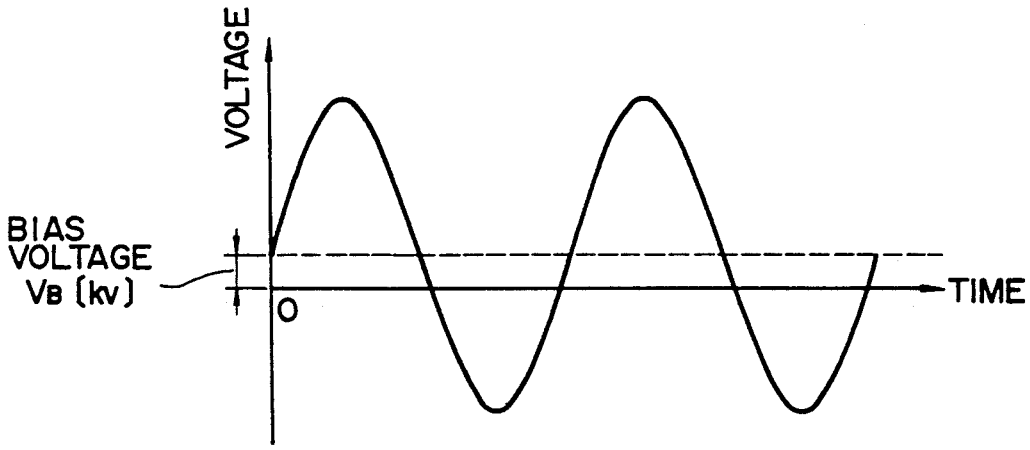
FIG. 14 is a wave diagram for illustrating a bias voltage used in the test of FIG. 12.

The invention will be further described by test examples. FIG. 12 illustrates a testing method and apparatus used herein. A single quartz covered emitter 2 having the construction as shown in FIG. 2 is disposed with its axis held vertical in a downwards flow of clean air flowing at a rate of 0.3 m/sec in a vertical laminar flow clean room. The tungsten rod 12 (FIG. 2) of the emitter 2 has a diameter of 1.5 mm The quartz tube 14 (FIG. 2) of the emitter 2 has an outer diameter of 3.0 mm and an inner diameter of 2.0 mm, and the length of the tapered end portion 15 (FIG. 2) of the quartz tube is 5 mm. The glass tube 18 (FIG. 2) of the emitter 2 has an outer diameter of 8 mm and an inner diameter of 6 mm, and contains a metallic conductor 17 (FIG. 2) of a 3 mm diameter passing therethrough. The emitter 2 is electrically connected to the voltage controlling device 5 via the vertically extending glass tube 18 and the horizontally extending resin covered tube 22 (FIG. 3). A grounded opposite conductor 3 including a ring of stainless steel is disposed so that its imaginary vertical center line may substantially coincide the axis of the emitter 2. The distance G between the discharge end 21 of the emitter 2 and the center of the opposite conductor ring 3 is controlled by vertically sliding the opposite conductor 3. In cases where the discharge end 21 is positioned upstream of the opposite conductor 3 with respect to the air flow (as shown in FIG. 7), the distance G is positive. Whereas, in cases wherein the discharge end 21 extends through the opposite conductor ring 3 and is positioned downstream of the opposite conductor 3 with respect to the air flow (as shown in FIG. 8), the distance G is negative. A diameter of the opposite conductor ring 3 is represented by D. A high voltage AC having added thereto a bias voltage is applied to the emitter 2 and densities of positive and negative ions (in $\times 10^3$ ions/cc) are measured at a location 1200 mm below the discharge end 21 of the emitter 2 using an air ion density meter 50. An effective AC component of the AC applied to the emitter 2 and the bias voltage added to the AC are represented by V and $V_B$, respectively. The effective AC component is $1/\sqrt{2}$ times the peak voltage, as shown in FIG. 13. The bias voltage VB denotes a DC component added to an AC wave, as shown in FIG. 14. $V_B$ is positive when the AC is positively biased, and is negative when the AC is negatively biased.

Figure 15:
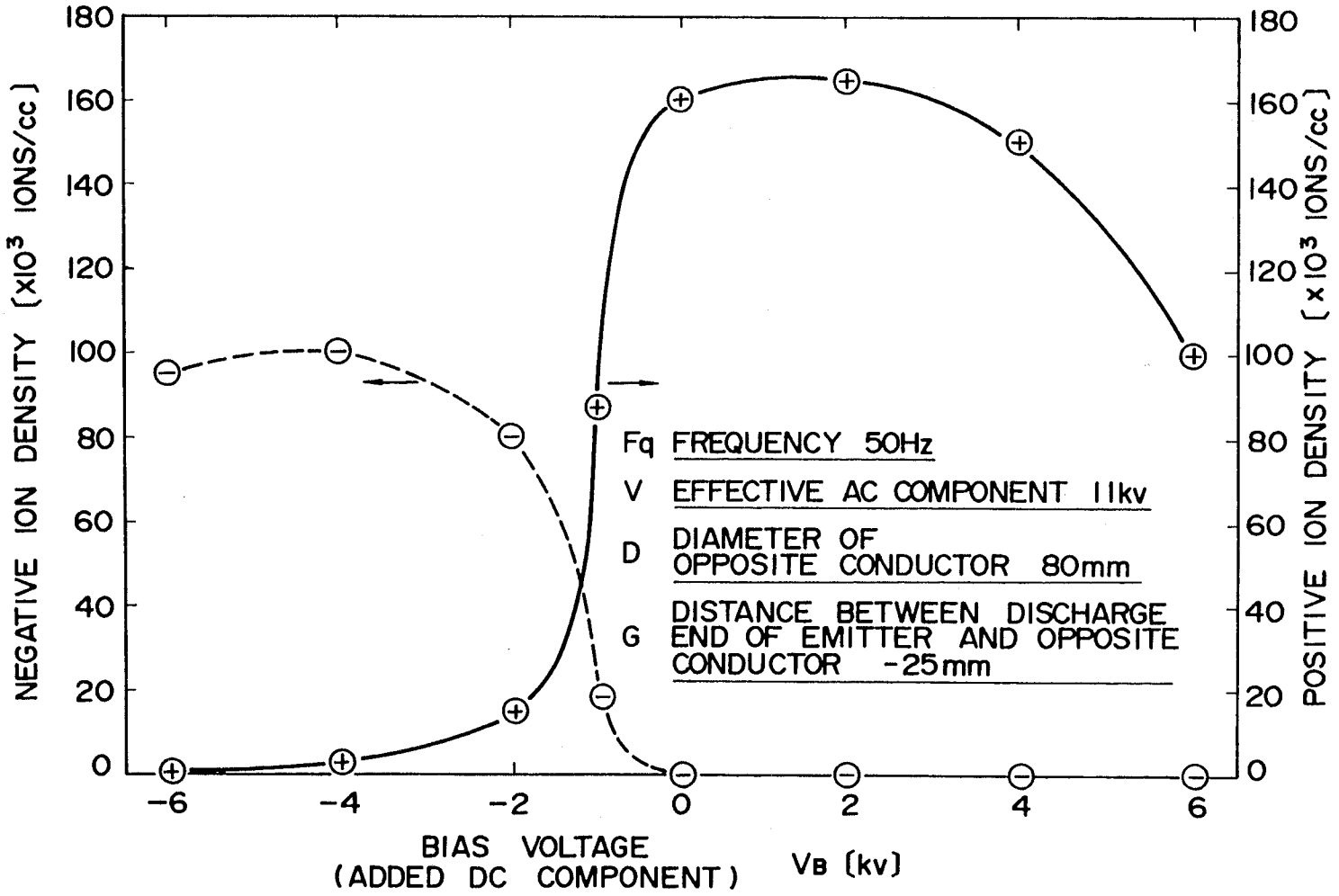
FIG. 15 is a graph showing measured positive and negative ion densities plotted against the added bias voltage $V_B$ obtained in the test of FIG. 12 under the indicated conditions.

FIG. 15 is a graph showing positive and negative ion densities measured by the air ion density meter 50 (FIG. 12) plotted against the added bias voltage $V_B$ under given conditions, including D=80 mm, G=−25 mm, V=11 kV and a frequency of the applied AC is 50 Hz. The results shown in FIG. 15 are very interesting in that in spite of the fact that AC is applied to the emitter, ionized air which is substantially inclined to positive or negative ions is formed by controlling $V_B$. The positive ion density is maximum where $V_B$ is about +2 kV, and drastically decreases as $V_B$ decreases to 0 through −2 kV. On the other hand, the negative ion density is maximum where $V_B$ is about −4 kV, and drastically decreases as $V_B$ increases −2 through 0 kV. Under the conditions employed, it is possible to generate substantially only either positive or negative ions by appropriately controlling $V_B$. For example, if $V_B$ is more positive than 0, positive ions are generated in a high density without a substantial generation of negative ions.

If $V_B$ is more negative than −3 kV, preferably more negative than −4 kV, negative ions are generated in a high density without a substantial generation of positive ions.

Under the conditions employed, both positive and negative ions are generated where the $V_B$ is within the range between −3 kV and 0 kV. Thus it is possible to generate both positive and negative ions from one and the same emitter. In this case, positive and negative ions are generated alternately in accordance with the frequency of the applied AC. Such a system in which positive and negative ions are alternately generated at a high frequency from one and the same emitter is, however, not necessarily advantageous, partly because the generated positive and negative ions are likely to be mutually neutralized before they reach charged articles, resulting in a reduction ion ions which are for effective neutralization, and partly because a slight change in $V_B$ within the above-mentioned range results in a significant change in ion densities, it is not easy to control $V_B$.

Under the conditions employed if a $V_B$ which is more positive than 0 is added to the emitter, it becomes an emitter capable of generating only positive ions (that is a pseudo positive pole emitter 2a of FIG. 1). If a $V_B$ which is more negative than $-3$ kV is added to the emitter, it becomes an emitter capable of generating substantially only negative ions (that is a pseudo negative pole emitter 2b of FIG. 1). Accordingly, by appropriately discretely arranging a plurality of the pseudo emitters 2a and 2b in a two dimensional expanse transversing the air flow, it is possible to supply a well balanced number of positive and negative ions to charged articles.

Figure 16:
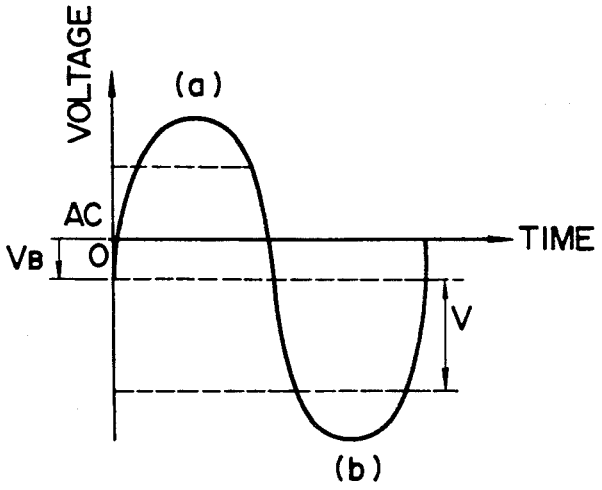
FIG. 16 is an AC wave diagram for illustrating effects of a bias voltage.
Figure 17:
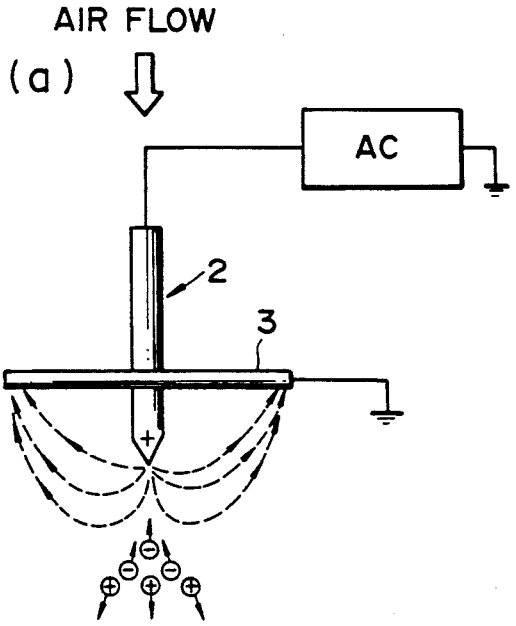
FIG. 17 is an explanatory diagram for showing the state of the discharge part at the time a positive voltage (a) of FIG. 16 is being applied.
Figure 18:
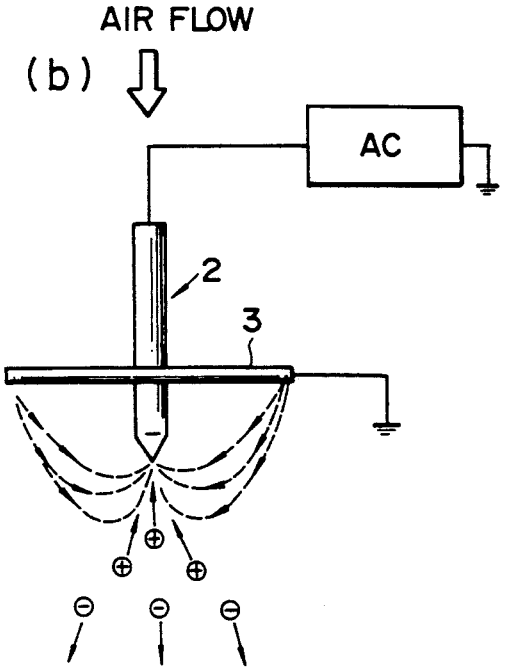
FIG. 18 is an explanatory diagram for showing the state of the discharge part at the time a negative voltage (b) of FIG. 16 is being applied.
Figure 19:
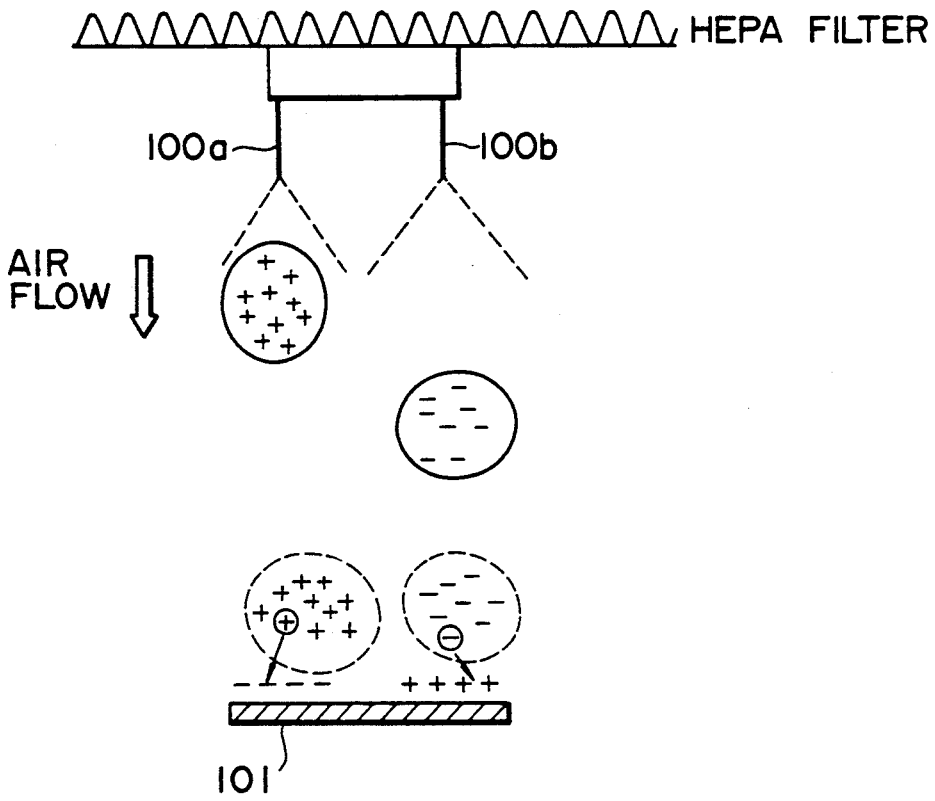
FIG. 19 is a schematic illustration of a conventional pulsed DC type ionizer.
Figure 20:
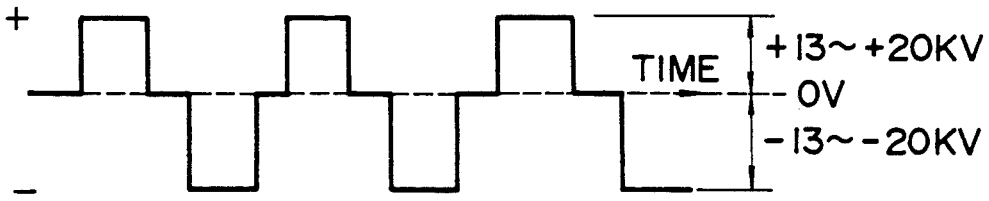
FIG. 20 is a wave diagram of a voltage applied to the ionizer of FIG. 19.
Figure 21:
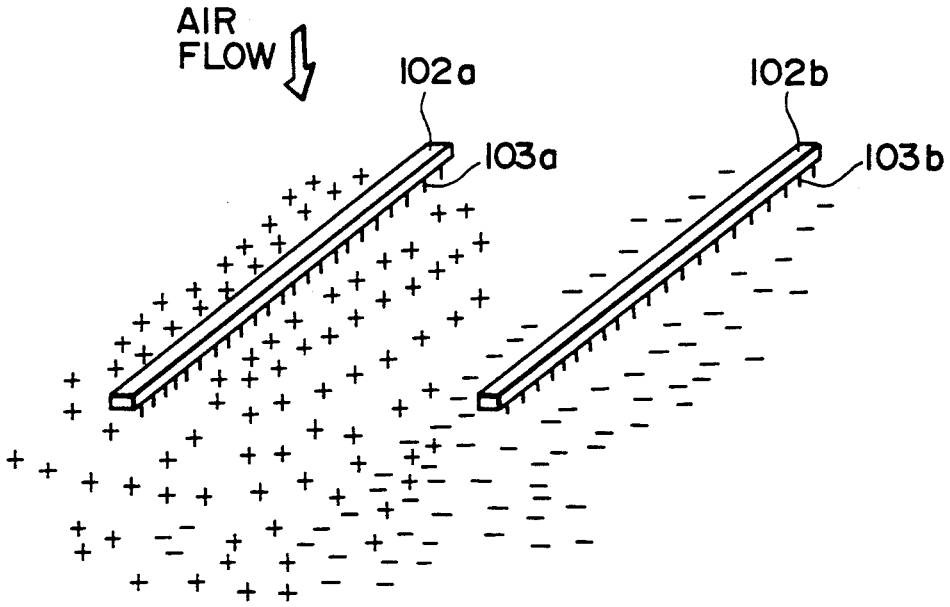
FIG. 21 is a schematic illustration of a conventional DC type ionizer.
Figure 22:
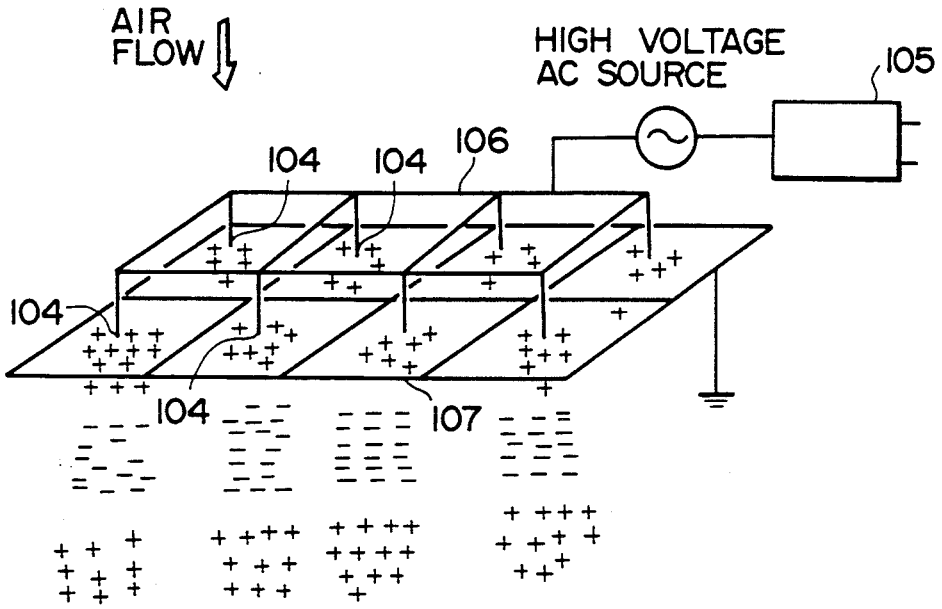
FIG. 22 is a schematic illustration of a conventional AC type ionizer.
Figure 23:
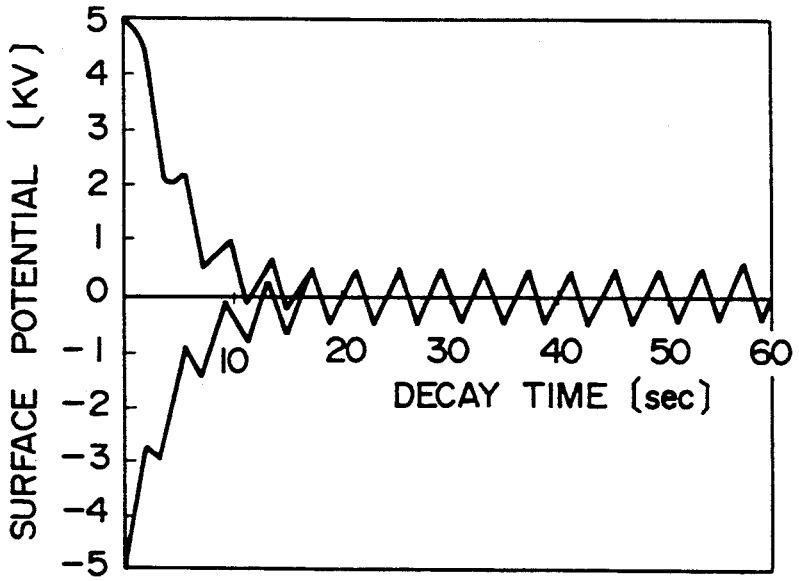
FIG. 23 shows an example of a change in surface potential of a charged article with respect to time when a conventional pulsed DC type ionizer is used.
Figure 24:
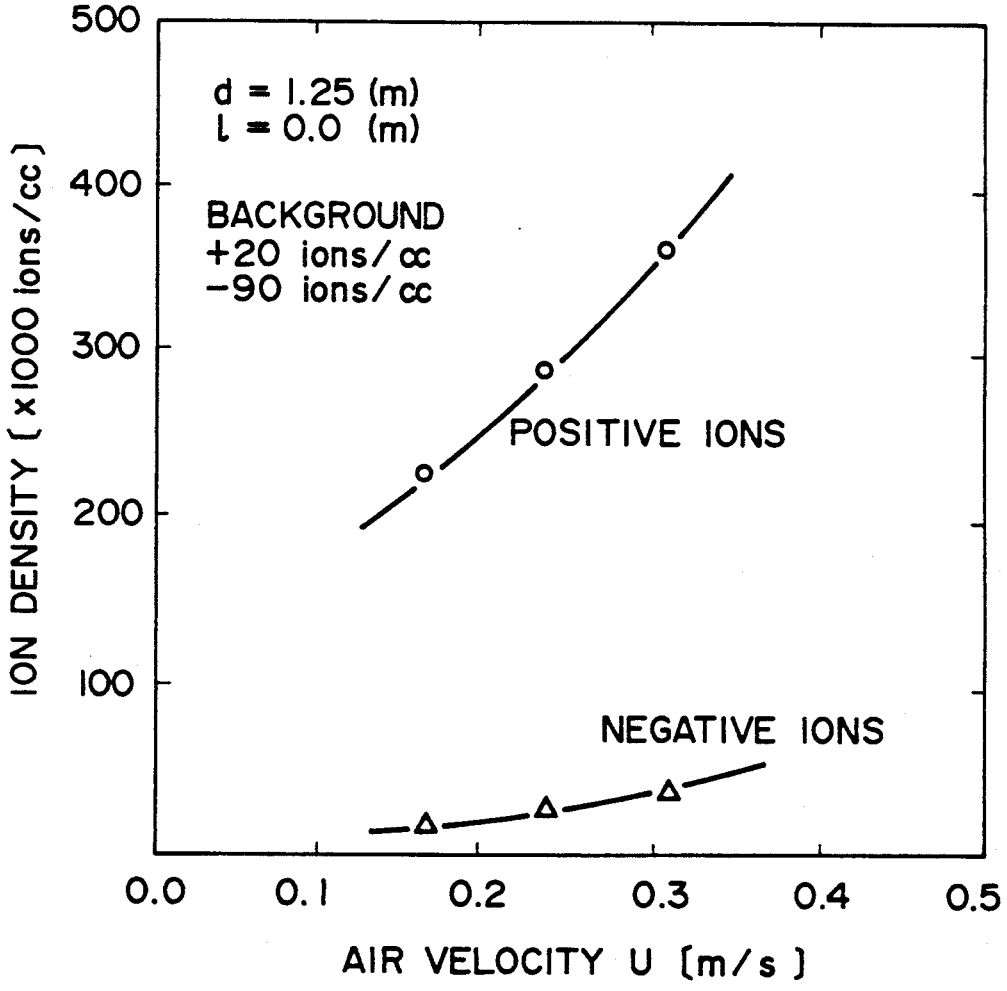
FIG. 24 shows an example of positive and negative ion densities generated by a conventional AC type ionizer.

FIGS. 16 to 18 are for illustrating effects of the bias voltage. With an AC having added thereto a negative voltage bias, the intensity of a positive voltage, shown by (a) in FIG. 16, $(V-|V_B|)$, which is lower than the effective AC component V by $|V_B|$. Whereas, the intensity of a negative voltage, shown by (b) in FIG. 16, is $(V+|V_B|)$, which is more negative than the effective AC component V by $|V_B|$. Accordingly, when this AC voltage is applied to the emitter, the intensity of the electric field in the vicinity of the discharge end of the emitter is stronger in the case of (b) than in the case of (a), whereby a Coulomb force for causing negative ions to move downwards is much larger than a Coulomb force for causing positive ions to move downwards. FIG. 17 is an explanatory diagram for showing the state of the discharge end at the time a positive voltage (a) of FIG. 166 is being applied In these figures, arrows attached to ions indicate the strength of the Coulomb force exerting the respective ions. Thus, in this case, while positive and negative voltages are applied to the emitter, more negative ions reach the air ion density meter 50 (FIG. 12) than positive ions.

We have repeated the tests using rates of air flow from 0.15 to 0.6 m/sec and varying the parameters V, G, D and $V_B$. It has been found that the optimum conditions for a pseudo positive pole emitter 2a include:

$$8\text{ kV} \leqq V,$$

$$-80\text{ mm} \leqq G \leqq 80\text{ mm},$$

$$50\text{ mm} \leqq D \leqq 150\text{ mm, and}$$

$$-8\text{ kV} \leqq V_B \leqq 8\text{ kV}$$

and that the optimum conditions for a pseudo negative pole emitter 2b include:

$$8\text{ kV} \leqq V,$$

$$-80\text{ mm} \leqq G \leqq 0\text{ mm},$$

$$50\text{ mm} \leqq D \leqq 150\text{ mm, and}$$

$$-8\text{ kV} \leqq V_B \leqq 0\text{ kV},$$

Thus, in the case of the pseudo negative pole emitter 2b, G is preferably negative, that is, the discharge end 21 of the emitter 2 preferably extends through the opposite conductor ring 3 so that the discharge end 21 may be positioned downstream of the opposite conductor 3 with respect to the air flow, as shown in FIG. 8, and the $V_B$ is preferably negative. In the case of the pseudo positive emitter 2a, G may either be positive or negative, that is, the discharge end 21 of the emitter 2 may be positioned upstream of the opposite conductor 3 with respect the air flow, as shown in FIG. 7, or it may extend through the opposite conductor ring 3 so that it may be positioned downstream of the opposite conductor 3 with respect to the air flow, as shown in FIG. 8, and $V_B$ may be negative or positive.

In the test of FIG. 12, where an AC high voltage of 20 kV was applied to the emitter, no generation of dust from the discharge end 21 was detected. In contrast, the same tests of FIG. 12 except where the emitter included an exposed tungsten rod 12 with the other conditions remaining the same, indicated significant generation of dust from the discharge end 21 when an AC high voltage in excess of 6 kv was used. The number of particles having a diameter larger than 0.03 μm measured at a location 160 mm below the discharge end 21 were $7.4\times10^2$ particles/ft$^3$ at 6 kV, $2.5\times10^4$ particles/ft$^3$ at 10 kV, and $2.9\times10^4$ particles/ft$^3$ at 20 kV. An emitter having a quartz tube 14 recommended herein was caused to work for a continued period of 1050 hours. At the end of the period, the discharge end of the emitter was examined using a microscope. It could not be distinguished from a new one, and no deposition of particulate dust and no damage were observed. Furthermore, an AC voltage of 11.5 kV was applied to an emitter recommended herein and an ozone concentration was examined at a location 12.5 cm below the discharge end of the emitter. Ozone in excess of 1 ppb was not detected.

By the apparatus according to the present invention almost all problems associated with the prior art can be solved and the difficulties caused by static electrification in the production of semiconductor devices can be overcome.

We claim:

1. An apparatus for removing static electricity from charged articles existing in a clean space comprising an Ac ionizer having a plurality of needle-like emitters disposed in a flow of filtered clean air, wherein an AC high voltage is applied to said emitters to effect corona discharge for ionizing air, whereby a flow of thus ionized air is supplied onto said charged articles to neutralize static electricity thereon, said apparatus characterized in that:

a discharge end of each of said needle-like emitters is coated with a dielectric ceramic material;

each of said emitters is disposed with its discharge end spaced apart at a predetermined distance from a grounded grid-like or loop-like opposite conductor, each emitter and associated opposite conductor forming a discharge pair;

a plurality of such discharge pairs are arranged in a two dimensional expanse in a direction transversing a flow direction of said flow of filtered clean air; and emitters of some of said discharge pairs are connected to a high voltage AC source having added thereto a negative voltage bias to thereby form pseudo negative pole emitters, and emitters of the other discharge pairs are connected to a high voltage AC source having added thereto a more positive voltage bias relative to said negative voltage bias to thereby form pseudo positive pole emitters, said pseudo negative pole emitters and pseudo positive pole emitters being discretely arranged in said two dimensional expanse.

2. The apparatus for removing static electricity from charged articles according to claim 1, wherein said clean space is for the production of semiconductor devices.

3. The apparatus for removing static electricity from charged articles according to claim 1 or 2, wherein said dielectric ceramic material is quartz.

4. The apparatus for removing static electricity from charged articles according to claim 1 or 2, wherein the discharge end of each pseudo negative pole emitter is positioned downstream of the associated opposite conductor relative to said flow direction.

5. The apparatus for removing static electricity from charged articles according to claim 1 or 2, wherein emitters of some discharge pairs are connected to a common high voltage AC source having added thereto a negative voltage bias to thereby form the pseudo negative pole emitters, and emitters of the other discharge pairs are connected to the common high voltage AC source having added thereto a positive voltage bias to thereby form the pseudo positive pole emitters.

6. The apparatus for removing static electricity from charged articles according to claim 1 or 2, wherein the high voltage AC sources are provided by a voltage controlling device having means for transforming a commercial AC into an AC of a predetermined high voltage and means for adding respective predetermined positively and negatively biased DC voltages to the thus transformed AC, and a voltage operating part for adjusting the AC high voltage and the biased DC voltages.

7. The apparatus for removing static electricity from charged articles according to claim 1 or 2, wherein the pseudo negative pole emitters and pseudo positive pole emitters are discretely arranged alternately in at least one direction within said two dimensional expanse,

8. The apparatus for removing static electricity from charged articles according to claim 3, wherein the discharge end of each pseudo negative pole emitter is positioned downstream of the associated opposite conductor relative to said flow direction.

9. The apparatus for removing static electricity from charged articles according to claim 3, wherein emitters of some discharge pairs are connected to a common high voltage AC source having added thereto a negative voltage bias to thereby form the pseudo negative pole emitters, and emitters of the other discharge pairs are connected to the common high voltage AC source having added thereto a positive voltage bias to thereby form the pseudo positive pole emitters.

10. The apparatus for removing static electricity from charged articles according to claim 3, wherein the high voltage AC sources are provided by a voltage controlling device having means for transforming a commercial AC into an AC of a predetermined high voltage and means for adding respective predetermined positively and negatively biased DC voltages to the thus transformed AC, and a voltage operating part for adjusting the AC high voltage and the biased DC voltages.

11. The apparatus for removing static electricity from charged articles according to claim 3, wherein the pseudo negative pole emitters and pseudo positive pole emitters are discretely arranged alternately in at least one direction within said two dimensional expanse.

12. The apparatus for removing static electricity from charged articles according to claim 4, wherein the high voltage AC sources are provided by a voltage controlling device having means for transforming a commercial AC into an AC of a predetermined high voltage and means for adding respective predetermined positively and negatively biased DC voltages to the thus transformed AC, and a voltage operating part for adjusting the AC high voltage and the biased DC voltages.

13. The apparatus for removing static electricity from charged articles according to claim 4, wherein the pseudo negative pole emitters and pseudo positive pole emitters are discretely arranged alternately in at least one direction within said two dimensional expanse.

14. The apparatus for removing static electricity from charged articles according to claim 5, wherein the high voltage AC sources are provided by a voltage controlling device having means for transforming a commercial AC into an AC of a predetermined high voltage and means for adding respective predetermined positively and negatively biased DC voltages to the thus transformed AC, and a voltage operating part for adjusting the AC high voltage and the biased DC voltages.

15. The apparatus for removing static electricity from charged articles according to claim 5, wherein the pseudo negative pole emitters and pseudo positive pole emitters are discretely arranged alternately in at least one direction within said two dimensional expanse.

16. The apparatus for removing static electricity from charged articles according to claim 6, wherein the pseudo negative pole emitters and pseudo positive pole emitters are discretely arranged alternately in at least one direction within said two dimensional expanse.

* * * * *